United States Patent [19]

Kelley

[11] Patent Number: 4,815,297

[45] Date of Patent: Mar. 28, 1989

[54] ENTHALPIC EVAPORATIVE AIR CONDITIONING DEVICE WITH HEATING

[76] Inventor: Franklyn F. Kelley, 7802 N. 36th Dr., Phoenix, Ariz. 85021

[21] Appl. No.: 38,020

[22] Filed: Apr. 14, 1987

Related U.S. Application Data

[63] Continuation-in-part of Ser. No. 607,751, May 7, 1984, Pat. No. 4,658,600.

[51] Int. Cl.[4] ..... F25D 17/06

[52] U.S. Cl. ..... 62/91; 62/311

[58] Field of Search ..... 62/311, 304, 309, 91, 62/171, 235.1; 236/49; 126/427; 165/60

[56] References Cited

U.S. PATENT DOCUMENTS 2,353,233 7/1944 Gygax ..... 62/311

*Primary Examiner*—Henry A. Bennet

*Attorney, Agent, or Firm*—Gregory J. Nelson

[57] ABSTRACT

An improved evaporative air conditioning device which in the cooling phase subjects the air to be treated to evaporative treatment. Prior to evaporative treatment the air to be treated is enthalpically heated utilizing radiant solar energy or other artificial heating to lower the water content per unit of volume and also lower the wet bulb temperature. In the preferred embodiment, a heat absorbent material is placed adjacent the inlet ducts to the unit. In the heating phase, the device is automatically controlled to provide solar induced heating during periods when sufficient solar energy induced heat is available.

15 Claims, 7 Drawing Sheets

DATA OBTAINED - 7/17/83

POINT A - FREE AIR AMBIENT TEMPERATURE & WET BULB

POINT B - TEMPERATURE AIR WAS HEATED TO & CORRESPONDING WET BULB

LINE AB - SHIFT LINE

LINE AD - NORMAL ADIABATIC LINE TO SATURATION AIR TEMP. 75.5° F.

LINE BC - NORMAL ADIABATIC LINE TO SATURATION AIR TEMP. 66.5° F.

IMPROVEMENT TO LOWER WET BULB = 75.5° - 66.5° = 9° F WET BULB

DATA OBTAINED AT NIGHT WITH ARTIFICIAL MEANS (NOT SOLAR HEAT)

POINT A–FREE AIR AMBIENT TEMPERATURE & WET BULB

POINT B–TEMPERATURE AIR WAS HEATED

IMPROVEMENT TO LOWER WET BULB = 115°F WB

ENTHALPIC EVAPORATIVE AIR CONDITIONING DEVICE WITH HEATING

This is a continuation-in-part of application Ser. No. 06/607,751, filed May 7, 1984, U.S. Pat. No. 4,658,600 of the same title.

The present invention relates to air conditioning devices and systems and more particularly air conditioning devices which operate on the principle of evaporative cooling.

Cooling air using the evaporative cooling effect has been utilized for many years, particularly in dry climates. These conventional cooling devices generally consist of a housing, which may be square or round, in which an air moving device usually in the form of a motor-driven centrifugal blower is mounted to induce a flow of ambient air into the housing through water-wetted pads located at the sides of the housing. As the relatively dry, ambient air passes through the wetted pads, the air is cooled by the evaporative effect and the air moving device delivers the cool air to a discharge which is connected to an appropriate air distribution system. Water for cooling is supplied from a sump located in the bottom of the cooler in which the water level is maintained by a float valve. The water is pumped from the sump to the wettable pads and is generally distributed across the top of the pads and allowed to flow downwardly through the pads under the influence of gravity.

Evaporative coolers of the general type described above have found wide acceptance because of their low cost and their effectiveness at least during certain periods of the year and in certain climates. However, there are a number of problems associated with the use, operation and maintenance of such evaporative cooler devices.

The wettable pads mounted at the sides of the cooler housing or cabinet generally are manufactured from a fiberous material such as excelsior or, in some newer models, utilize a pad of treated paper having channels therein such as those sold under the name "Celdek". In any case, the pads in which the evaporation occurs deteriorate and become contaminated over a period of use. Since evaporation occurs within and on the surfaces of the pads, calcification and mineral deposits along with dirt and other foreign matter will collect in the pads increasing the resistance to air flow.

Further, the moisture laden air emerging from the cooler pads in the cabinet interior will deposit moisture on the operating surfaces. For this reason, cabinet surfaces, motor mounts, pumps and the like are all subject to corrosion.

The above problems are common to most evaporative coolers due to the inherent nature and operation of such devices. Beyond the mechanical and maintenance problems cited above, certain functional and operational problems are inherent in to coolers of this type. As discussed above, these devices draw ambient air through cooler pads and rely on the evaporation effect for cooling. The result is that air is cooled toward the wet bulb temperature which is in almost all instances lower than the ambient air temperature and then directed into the area to be cooled. Architectural design standards rate conventional evaporative cooling machines are being approximately 60 to 80 percent efficient in reaching a saturation temperature where maximum cooling is achieved. This means that when the wet bulb for a given day is 80 degrees Fahrenheit, the ambient air temperature will be lowered to within 60 to 80 percent of the web bulb and the resulting air cooling will be above 80 degrees Fahrenheit. This saturation efficiency short fall places these cooling machines at a disadvantage particularly in conditions of hot, wet air. Such periods are common in the Southwestern United States in the months of July and August when a phenomonon called "Monsoons" occurs in which warm, moist tropical air is pushed north into the Southwestern United States. It is not uncommon during these periods to have air conditions of 110 degrees Fahrenheit dry bulb and 80 degrees Fahrenheit wet bulb. At 80 percent saturation efficiency, air treated using the evaporative effect would be cooled only to 86 degrees Fahrenheit. Obviously, this is quite uncomfortable and well in excess of the comfort zone which is generally considered to be approximately 72 to 76 degrees Fahrenheit. Accordingly, evaporative coolers are not effective during this time and users either have to endure degraded cooling or revert to more expensive devices to operate such as conventional vapor comparison cycle air conditioning systems.

Further, evaporative cooler devices are generally not used at all in winter periods in addition to being limited in the summer by ambient conditions. In view of the limited periods of usefulness of evaporative coolers, there exists a need for an improved evaporative cooler which has a longer period of operational effectiveness and which can be used for cooling even in periods of relatively hot, moist air and also can be utilized for lowering heating expenses in at least moderate winter climates.

In accordance with the present invention, a new and improved evaporative air conditioning device is disclosed which is useful both during the cooling season and during the heating season. In milder climates during the winter months, there are a substantial number of days in which the daytime temperature exceeds 68 degrees Fahrenheit. As this temperature is approached, the air above a surface exposed to solar radiation exceeds 72° F. These hours occur predominantly during the day and display an inverted bell-shape distribution curve which favors early and late winter for best solar induced heat availability. The air conditioning device of the present invention is thermostatically controlled to provide solar induced heat to an area during periods when sufficient solar heating is available and is therefore termed "enthalpic heating" since it utilzes solar heating (passive solar energy) introduced from outside the system of the invention. The device of the present invention includes a control system in which a low voltage thermostatic heat sensing switch for winter heating operation makes contact on a predetermined temperature rise to complete the low voltage thermostatic circuit in the house and allows the blower within the evaporative air conditioning unit to run when ambient warm air is present for heating in the home. In the preferred embodiment the evaporative air conditioning unit also includes a high efficiency capacitor start capacitor run AC electric motor on a permanent magnet brush or brushless DC electric motor of the orientated ferrite-type permanent magnet field for electrical power reduction.

In the enthalpic cooling phase of operation, the air conditioning unit of the present invention includes a motor-driven air moving device which is open to ambient air having a discharge connected to the area to be cooled. Air is cooled by evaportion either at conventional pads at the exterior of the housing or in specially designed evaporator ducts within the air flow path. Water may be distributed across the conventional pads or may be supplied under pressure from a suitable source by one or more spray nozzles located in an expansion chamber area within the air flow path. The improved cooling efficiency is obtained by expanding the air prior to its entry into the unit by utilizing heat provided by radiant solar energy. In the preferred embodiment, a heat absorbent material is placed adjacent the cooler intake to heat the incoming air above the ambient free-air temperature. When the air is heated it expands thereby lowering the water content per unit of volume which results in a lower humidity level and dryer air. The expanded dryer air has a lower wet bulb temperature which results in a lower temperature of cooled air being discharged from the unit than would be possible by drawing in untreated ambient air.

The enthalpic heating of incoming air may be applied to conventional coolers of square or round design or may be used with high efficiency coolers such as is shown in my prior patent, U.S. Pat. No. 4,308,222.

The foregoing and other objects of the present invention will be more fully understood from the following description when read in conjunction with the accompanying drawings in which.

Figure 1:
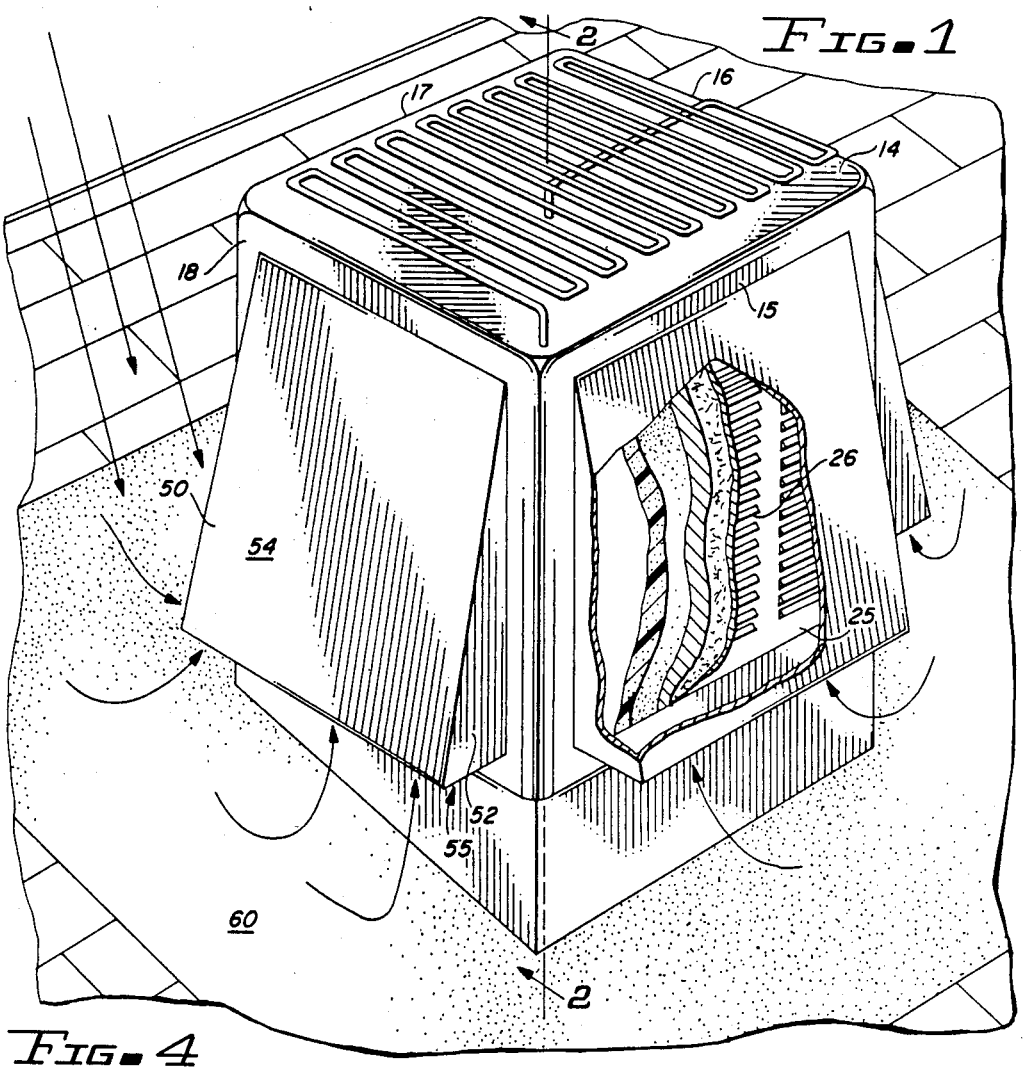
FIG. 1 is a perspective view of a conventional evaporative cooler incorporating solar enthalpic cooling and heating features according to the present invention.
Figure 2:
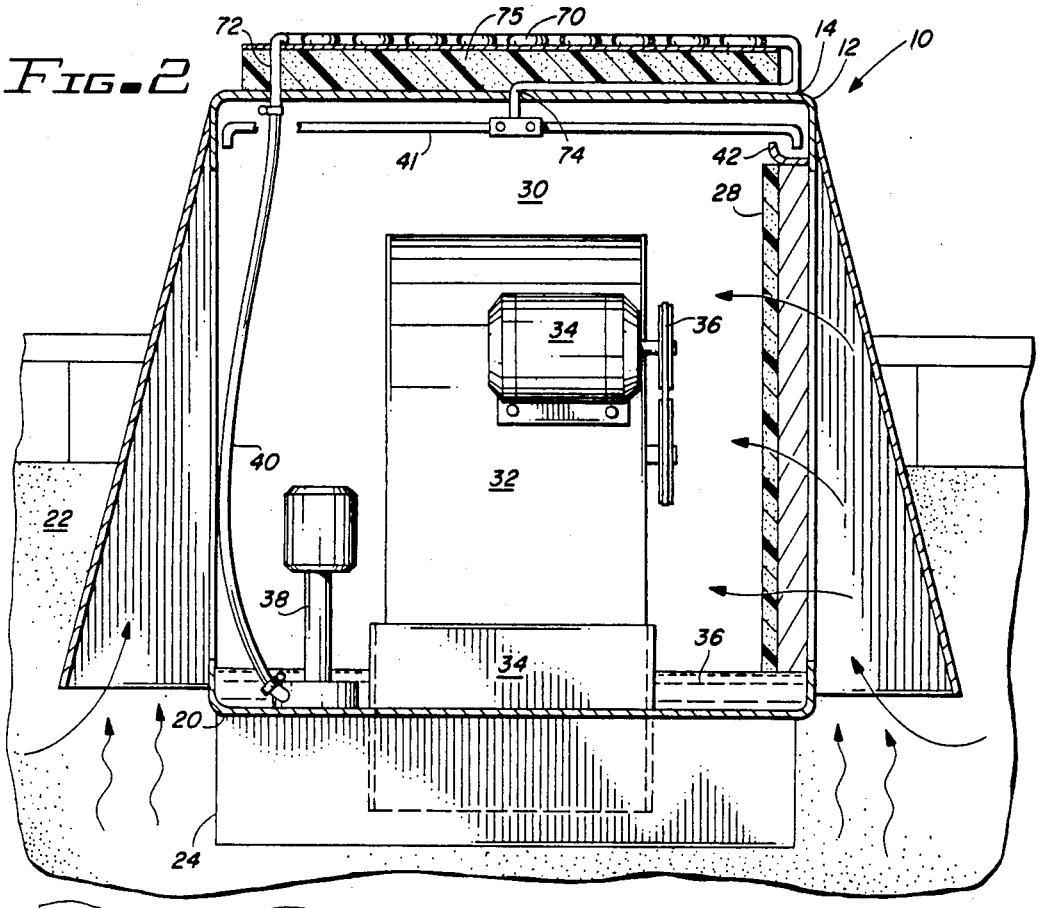
FIG. 2 is a sectional view along lines 2—2 of FIG. 1.
Figure 3:
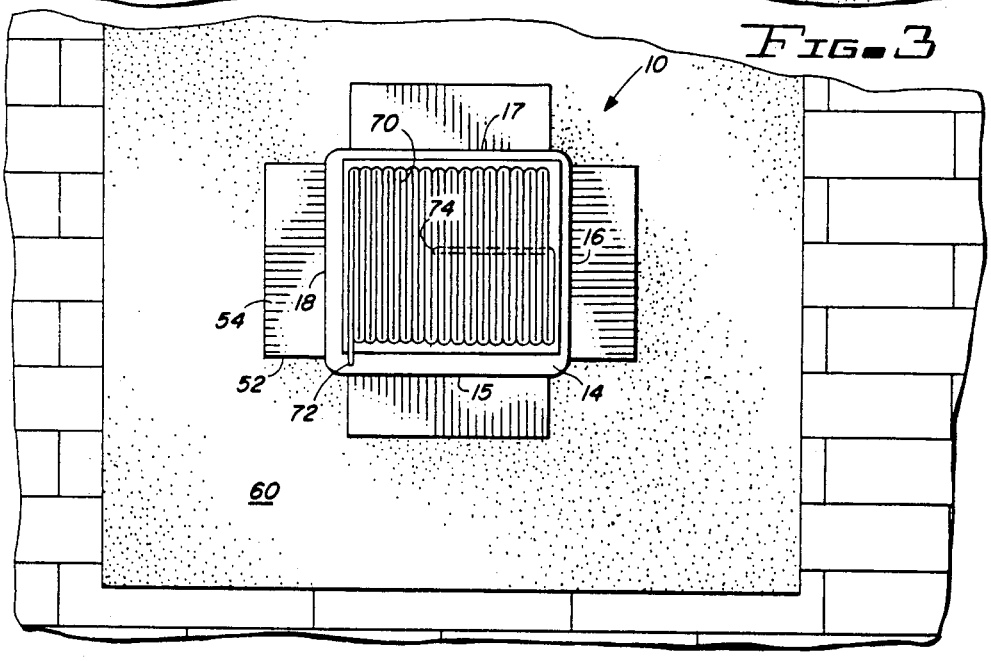
FIG. 3 is a top view of the cooler shown in FIGS. 1 and 2.

Turning now to the drawings, particularly FIGS. 1 to 3, a conventional evaporative cooler is generally designated by the numeral 10. The conventional cooler 10 includes a generally horizontal top 14, vertical sides 15 to 18 and bottom 20. The housing or cabinet may be fabricated from any suitable material as is conventional such as fiberglass, stainless steel, plastic or a suitable galvanized or rust proofed sheet metal to minimize the corrosive effect of moisture. The cooler 10 is shown mounted on a pitched roof 22 on base 24. Each of the sides of the cooler 15 to 18 defines a generally rectangular opening which accommodates a removable panel 25 defining a plurality of air louvers 26. Replaceable wettable pads 28 such as excelsior pads wrapped in large mesh cheese cloth are detachably secured at the inner side of the panels 25. Air moves through the louvers 26 and across the pads 28 to the interior chamber 30 of the cooler housing. An air moving device shown as centrifugal blower 32 driven by motor 34 through belt and pulley arrangement 36 is mounted on interior cabinet for drawing ambient air to the cabinet interior. The air moving device discharges at outlet 34 which delivers cool air to the area to be cooled usually through an appropriate air distribution system. A suitable barometric damper may be inserted at the outlet to prevent conditioned air loss when the system is not operating.

A sump 36 is located in the bottom of the cooler cabinet and maintains a reservoir of water at a predetermined level by a float valve, not shown. A circulating pump 38 delivers water from the sump 36 via line 40 and distribution tubes 41 to channels 42 along the top of the pads at the side of the cabinet. The water delivered to the tops of the pads by the delivery tubes 41 flows under the influence of gravity through the pads and the unevaporated water returns to the sump 36 for recirculation. The foregoing is a description of a conventional cooler which comprises no part of the present invention and is set forth for general background only.

The particular size, shape and type of cooler to which the present invention may be applied may vary considerably. For example, the cooler may be constructed of various materials and may be different shapres such as rectangular, square or even round or have one or more pads which may be any suitable shape.

The improvement of the pesent invention consists of providing means for preheating the air entering the cooler above ambient and also in some instances providing means for elevating the temperature of the water entering the cooler or circulating through the cooler to speed-up the evaporation rate. As has been pointed out above, conventional evaporative cooler machines are generally considered to be only 60 to 80 percent efficient in reaching the saturation temperature at which maximum cooling is achieved. This saturation efficiency makes conventional evaporative coolers ineffective during times of hot, moist air for example 110 degrees Fahrenheit dry bulb and 80 degrees wet bulb. However, an improvement in the saturation efficiency can be obtained by altering the conditions of the air entering the cooler from ambient. By increasing the temperature of the air entering the cooler, a lower wet bulb temperature is produced. For example, if the ambient air temperature is 97.5 degrees Fahrenheit and the wet bulb 70 degrees, at 100 percent saturation efficiency the conventional cooling unit would produce 70 degrees Fahrenheit air. However, with the present invention, discharged air temperatures of 68 degrees Fahrenheit and lower were obtained. Using the saturation efficiency equation:

$$\frac{97.5\text{ F.} - 68\text{ F.}}{97.5\text{ F.} - 70\text{ F.}} \times 100 = 107.3\%\ SE$$

The above result appears to be inconsistent with principles of physics upon first inspection. However, upon consideration the result is explained by the fact that when air is heated it expands thereby lowering its water content per unit of volume which results in a lower humidity level and dryer air and a lower possible wet bulb at saturation. Dryer air has a lower wet bulb temperature thereby resulting in an improved saturation efficiency.

To this end, the cooler 10 in the present invention is provided with an intake duct 50 at each of the air intake openings at the sides of the unit. Each of the ducts consist of a pair of generally triangular side panels 52 extending at right angles and arranged adjacent at the opposite sides of the inlet openings. A cover panel 54 extends between the side panels having its upper edge engaging the cooler side so that an inlet 55 is defined at the lower end of the duct to permit air to enter the duct and pass through the louvers 26 and the adjacent pad 28. The duct 54 may be attached to the housing by screws or may be detachably secured by wing nuts or turn lock fasteners. Duct 54 is preferably fabricated from a suitable heat absorbing material such as sheet metal or suitable plastic coated with an absorptive coating such as black paint. Thus air entering at inlet 55 will be heated enthalpically by solar radiation prior to entering the evaporative cooler. Further, duct 50 serves to minimize the effect of wind by bringing the intake closer to the warm mounting surface and preventing temperature dilution once this effect is achieved.

Additional enthalpic heating is obtained by solar absorber pad 60 which is placed on the roof surface 22 in an area adjacent and surrounding the cooler. The absorber pad 60 is shown as a sheet material having heat absorbing characteristics and again may be metal coated with a suitable absorptive coating or may be a material such as black roofing material or black vinyl film. Typically pad 60 would extend at least several feet outwardly from the cooler 10. Because of the configuration of duct 50, air entering the cooler necessarily has to pass in close proximity to the surface of pad 60 which serves to heat the incoming air above free-air ambient temperature due to the effects of solar radiation. This is a passive system and enthalpic heating of the incoming air is achieved without the expenditure of any additional energy costs which results in increased saturization efficiency and colder output air temperature. A translucent or transparent intake tunnel to further pre-heat incoming air may be placed at the duct inlet. As mentioned, the system is optimally a passive system utilzing solar energy although other forms of energy may be used to heat and expand the incoming air if economically feasible.

In addition to heating incoming air, it has been found that elevating the temperature of the water delivered to the evaporative pads also provides a beneficial effect as heating speeds the evaporation rate. To this end, a heat exchanger 70 consisting of a series of coils of tubing 71 such as copper tubing are positioned above the top 12 of the cooler. The coils 71 have an inlet 72 which is connected to water delivery line 40. The outlet 74 from the heat exchanger 70 is connected to the water distribution system 41 which distributes water to channels 42 at the top of the pads 28. In order to prevent the cooled air in interior chamber 30 from being heated due to the effects of coil 70, a suitable layer of insulation 75 is interposed beneath the coils and above the top surface 12 of the cooler.

Figures 5, 6:
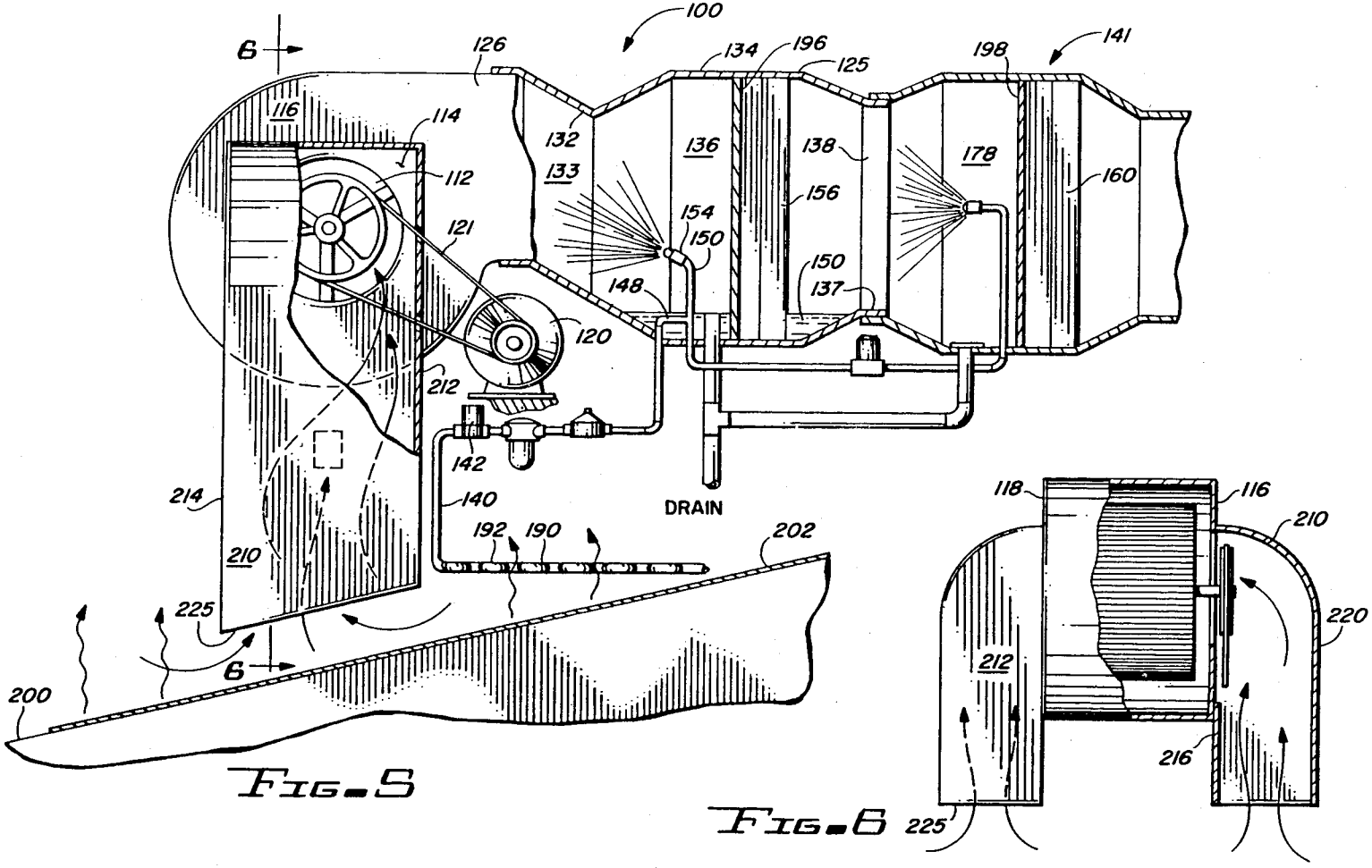
FIG. 5 is an elevational view, partly in section, showing the enthalpic cooling improvement applied to a high efficiency evaporative cooler.
FIG. 6 is a sectional view taken along lines 6—6 of FIG. 5.

The improved enthalpic system of the present invention may be used in conjunction with conventional evaporative coolers and provided as a factory installed feature or can be easily retro-fit in existing installations. The enthalpic cooling feature will benefit all types of evaporative coolers and works particularly well with improved efficiency coolers of the type shown in my prior patent, U.S. Pat. No. 4,308,222. In this regard, FIG. 5 shows the enthalpic feature applied to an improved cooler of this type. Briefly, the improved cooler 100 includes a centrifugal blower 112 or other air moving device having axial inlets 114 formed in the opposite side walls 116 and 118 of the housing. The blower is driven by electric motor 120 through a belt and pulley arrangement 121. Motor 120 is preferably a high efficiency capacitor start, capacitor run AC electric motor such as those manufactured by Westinghouse No. 327-P313, a permanent magnet brush or brushless DC electric motor of the orientated ferrite type permanent magnet field. Typically, such a motor would be rated at ¾ horse-power at 1800 RPM drawing 115 volts at 3 amps. A rectified AC to DC brushless or brush electric motors can also be used to achieve improved electrical efficiency.

An elongated evaporator duct 125 is positioned to receive air under pressure from the blower 112. The configuration of the evaporator duct includes an inlet section 132 connected to air outlet 126 which defines an air inlet passage 133. The air inlet duct section 132 converges and is integral with the main enlarged duct section 134 which defines an expansion chamber 136. The opposite end of the main duct section 134 is reduced to form an outlet air section 137 which defines an air outlet port 138. Subsequent tandemly arranged sections 141 of similar construction may be provided along with a suitable barametric damper as discussed above.

Water supply line 140 is connected to receive water under pressure from a suitable source and includes a valve 142 which may be manually or remotely operable. The water supply line 140 passes through the wall of the enlarged duct section 134 of the evaporator duct 130 and is arranged to form a series of coils 148 disposed adjacent to the bottom of the expansion chamber 136 with the bottom of the expansion chamber serving as a water collection sump 150.

The discharge from coils 148 is connected by conduit 150 to one or more spray nozzles 154 so that water supplied under pressure through line 140 is sprayed in a finely divided mist from the nozzles in a direction which extends angularly upwardly from the nozzle countercurrent to the air movement through the air inlet duct section 132. Accordingly, evap-oration and cooling of the incoming air occurs within the air inlet duct section 132 and because of the angular attitude of the air inlet duct section, migration of moisture for the air moving 112 is inhibited.

An extractor 156 is located in the expansion chamber 136 downstream of spray nozzle 154 to remove free moisture from the moving air by providing a torturous path through which the air must move. The extractor 156, as more fully explained in U.S. Pat. No. 4,308,222, includes a first bank of vanes which are in spaced parallel relationship with one another and are disposed transversely and vertically within expansion chamber. A second plurality of vanes 160 are positioned immediately downstream of the first plurality of vanes. The first extractor is arranged to deflect the moving air toward one side of the evaporator duct 130 and the second extractor is arranged to deflect the air toward the opposite side of the evaporator duct. The moving air will negotiate the torturous path through the extractor 156. Free moisture carried by the moving air will impinge on the extractor vanes and due to the influence of gravity will be collected in the sump 150.

The details of the cooler as set forth above are more fully described in my prior above-referenced U.S. patent and set forth here as background for a better understanding of the improvement constituting the present invention. The basic cooler design of U.S. Pat. No. 4,308,222 forms no part of the present invention.

The features of the improvement include a heat exchanger 190 in waterline 140 consisting of a plurality of coils 192 arranged in serpentine fashion at a location adjacent the cooler where the coils would be subject to full exposure to radiant energy. Cooler 100 may be mounted in any suitable location but generally units of this type are centrally mounted on the roof 200 of the building housing the area to be cooled. Accordingly, heat exchanger 192 is positioned adjacent to the cooler immediately above the roof 200 at a location where a suitable heat absorbing surface 202 such as black vinyl or black roofing material is placed.

At oppositely disposed axial openings 114 the side walls 116 and 118 are each provided with a shroud or housing 210. Each shroud or housing 210 extends from the oppositely disposed axial openings 114 to the unit housing and depends to an elevation just above the roof 200. Each shroud 210 is constructed of a fiberglass, sheet metal or similar material and includes opposite side panels 212 and 214, rear panel 216 and a front panel 220. The upper end of the front panel 220 is curved to form an elbow so that the incoming air is directed into the axial inlet to the fan. The housing 210 may be coated with a heat absorbing coating such as black paint.

The lower end of housing 210 is open at 225 at an elevation just above the roof surface 220. In the area of the opening 225 appropriate heat absorbing material 202 covers the roof. Radiant energy is absorbed by covering 202 which serves to heat the air passing over the covering prior to entering inlet 225 and which causes the air to expand lowering the water content per unit or volume resulting in a lower wet bulb and increased saturization efficiency.

Dust filters 196 and 198 are interposed in the air flow path immediately upstream of the extractors 156 and 160. The filters may be any suitable material such as fiberglass, perforated metal, or excelsior mat and wetted by water spray or by a conduit, not shown, connected to line 140. The filters 196 and 198 provide a slight increase in saturization efficiency but are primarily used to prevent dust, pollen and contaminants from entering into the air distribution system particularly when the system is used for heating purposes. In the cooling cycle these filters also prevent evaporation by-products from entering the treated air space.

The present invention also comprehends use of a conventional evaporative cooler or the improved cooler of U.S. Pat. No. 4,308,222 for providing heat in place of an expensive furnace or heat pump during certain conditions. By incorporating an electric analog control system as shown in FIG. 4, the enthalpic systems of the invention can be used to deliver heat to an area.

Figure 4:
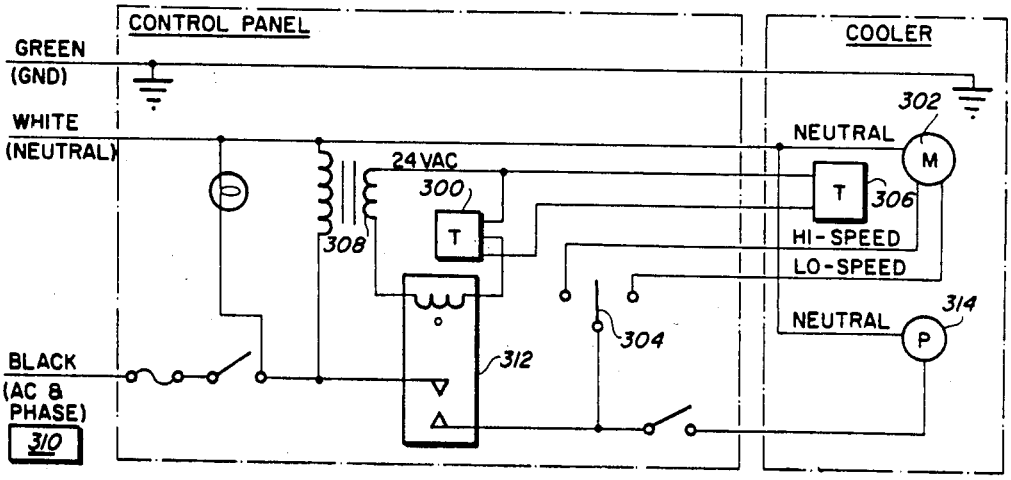
FIG. 4 is a schematic showing the electrical control system for the enthalpic heating and cooling system.

In FIG. 4, thermostat 300 is a low voltage heating and cooling control thermostat which controls the operation of the system and typically is set to make contact at 72 degrees F. Motor 302 is a single, continuously variable or multiple fixed speed motor in the cooler operated by switch 304. Thermostat 306 is a make on temperature rise type, located at an appropriate location on the roof adjacent the unit and is set at typically, 72 degrees F. Line voltage is reduced to 24V by step-down transformer 308. The heat pump control 310 controls the heat pump, not shown, and typically is a double set back Honeywell T8082A set at 60 degrees F heat, normal 72 degrees F.

Low voltage power breaker 312 is normally open and controls the line voltage to the motor 302 and to the optional water pump 314 or the water control solenoid at the cooler.

In the heating season when outside air is above 72 degrees F as determined by thermostat 306 and the thermostat 300 demands heat, a circuit will be completed by thermostats 300 and 306 and motor 302 will turn on to deliver enthalpic heat through the cooler unit. The water spray is in the off position. The system will operate only when ambient air in the vicinity of thermostat 306 is above the 72 degrees F set point. If the ambient falls below the set point, motor 302 will not be activated and the conventional heat pump is energized by control 310 to supply the necessary heating. When the control thermostat again senses that the ambient has reached a predetermined set point, the heat pump is deactivated. Control 310 includes a relay in the low voltage side which is open in response to thermostat 306 to defeat the heat pump when thermostat 306 is registering above set point. The system will work equally well with a conventional furnace for defeating the furnace operating when sufficient solar heating energy is available.

In order to test the effectivness of the present system, an improved evaporative cooler built according to U.S. Pat. No. 4,308,222 was installed on the roof of a 2200 square foot livable home in Phoenix, Ariz. Two 34 x 31 x 1 inch fiberglass air filters were placed in front of each water separator. Air filters were added to prevent insects, gases, contaminates and dirt from entering the house. Black rolled roofing was placed around the unit to achieve radiant heating of the incoming air to the unit. Further, the water supply to the unit was heated in copper coils exposed radiant thermal energy and placed immediately above the black rolled roofing. The evaporative cooling experiment with the high saturation efficiency modificate was conducted over a period from July 14, 1983 through Sept. 13, 1983. This is a period, when in the Southwest deserts, monsoons are prevalent and periods of high humidity and high temperature are encountered. By using the improvement of the present invention, it was possible to obtain an average saturation efficiency of 119.3% through the 60 day test. Some individual readings were as high as 150% and none were lower than 108%. The daily readings for this period are summarized as follows on Chart 1 and 2. A computer was used to reproject the same data at 80% saturation efficiency. For comparison on Charts 3 and 4 which follow:

EVAPORATIVE COOLER EXPERIMENT
SUMMER COOLING SEASON OF 1983 WITH HIGH SATURATION EFFICIENCY EXPERIMENT USING COOLER OF PATENT NO. 4,308,222
PREPARED BY F. F. KELLEY
DATE OCT. 12, 1983

| YEAR 83 DATE | HIGH TEMP. F. | WETBULB TEMP. F. | OUTSIDE HUMIDITY % | HOUSE AIR TEMPERATURE F. | COOLER OUTPUT F. | INSIDE HUMIDITY % | SATURATION EFFICIENCY % | WATTMETER STARTING NO. | DAILY READING | DAY | AVERAGE KWH/DAY | SIXTY DAY PROJECTION KWH |
|---|---|---|---|---|---|---|---|---|---|---|---|---|
| JUL 14 | 104.5 | 78.0 | 32 | 77.0 | 75.0 | NR | 111.321 | 5419 | 5422.0 | 1 | 30.0 | 1860 |
| JUL 15 | 101.0 | 77.0 | 40 | 77.0 | 74.0 | NR | 112.500 | 5419 | 5425.0 | 2 | 30.0 | 1860 |
| JUL 16 | 99.5 | 76.5 | 37 | 77.0 | 72.5 | NR | 117.391 | 5419 | 5428.5 | 3 | 31.7 | 1963 |
| JUL 17 | 101.0 | 77.0 | 35 | 76.0 | 71.0 | NR | 125.000 | 5419 | 5431.0 | 4 | 30.0 | 1860 |
| JUL 18 | 94.0 | 75.0 | 40 | 77.0 | 71.5 | NR | 118.421 | 5419 | 5433.0 | 5 | 28.0 | 1736 |
| JUL 19 | 100.0 | 75.0 | 32 | 77.0 | 73.0 | NR | 108.000 | 5419 | 5435.0 | 6 | 26.7 | 1653 |
| JUL 20 | 92.0 | 74.5 | 45 | 78.0 | 72.5 | NR | 111.429 | 5419 | 5437.0 | 7 | 25.7 | 1594 |
| JUL 21 | 84.0 | 76.5 | 73 | 77.0 | 73.0 | NR | 146.667 | 5419 | 5440.0 | 8 | 26.3 | 1628 |
| JUL 22 | 89.5 | 78.5 | 63 | 78.0 | 75.0 | NR | 131.818 | 5419 | 5441.0 | 9 | 24.4 | 1516 |
| JUL 23 | 99.5 | 82.0 | 49 | 80.0 | 77.0 | NR | 128.571 | 5419 | 5444.0 | 10 | 25.0 | 1550 |
| JUL 24 | 99.0 | 82.5 | 64 | 80.0 | 78.0 | NR | 127.273 | 5419 | 5446.5 | 11 | 25.0 | 1550 |
| JUL 25 | 95.5 | 77.5 | 47 | 78.0 | 74.0 | NR | 119.444 | 5419 | 5450.0 | 12 | 25.8 | 1602 |
| JUL 26 | 100.0 | 75.0 | 32 | 78.0 | 73.0 | NR | 108.000 | 5419 | 5451.0 | 13 | 24.6 | 1526 |
| JUL 27 | 97.0 | 79.0 | 47 | 78.0 | 75.0 | NR | 122.222 | 5419 | 5453.5 | 14 | 24.6 | 1528 |
| JUL 28 | 98.0 | 75.0 | 34 | 78.0 | 73.0 | NR | 108.696 | 5419 | 5456.0 | 15 | 24.7 | 1529 |
| JUL 29 | 100.5 | 78.5 | 40 | 78.0 | 75.0 | NR | 115.909 | 5419 | 5458.5 | 16 | 24.7 | 1531 |
| JUL 30 | 97.0 | 77.0 | 37 | 79.0 | 74.0 | NR | 115.000 | 5419 | 5462.0 | 17 | 25.3 | 1568 |
| JUL 31 | 97.5 | 82.0 | 53 | 79.0 | 77.0 | NR | 132.258 | 5419 | 5465.0 | 18 | 25.6 | 1584 |
| AUG 1 | 100.0 | 80.0 | 44 | 79.0 | 76.5 | NR | 117.500 | 5419 | 5467.5 | 19 | 25.5 | 1583 |
| AUG 2 | 100.5 | 78.0 | 48 | 80.0 | 76.0 | NR | 108.889 | 5419 | 5471.0 | 20 | 26.0 | 1612 |
| AUG 3 | 98.0 | 80.0 | 47 | 80.0 | 77.0 | NR | 116.667 | 5419 | 5473.0 | 21 | 25.7 | 1594 |
| AUG 4 | 92.0 | 76.0 | 37 | 80.0 | 74.0 | NR | 112.500 | 5419 | 5475.5 | 22 | 25.7 | 1592 |
| AUG 5 | 92.5 | 80.0 | 60 | 80.0 | 75.0 | NR | 140.000 | 5419 | 5478.0 | 23 | 25.7 | 1590 |
| AUG 6 | 102.5 | 79.0 | 38 | 80.0 | 76.5 | NR | 110.638 | 5419 | 5481.5 | 24 | 26.0 | 1615 |
| AUG 7 | 93.0 | 79.0 | 55 | 81.0 | 76.0 | NR | 121.429 | 5419 | 5484.0 | 25 | 26.0 | 1612 |
| AUG 8 | 85.0 | 77.0 | 70 | 79.5 | 72.5 | NR | 156.250 | 5419 | 5487.0 | 26 | 26.2 | 1622 |
| AUG 9 | 91.0 | 76.0 | 50 | 77.5 | 74.0 | NR | 113.333 | 5419 | 5491.0 | 27 | 26.7 | 1653 |
| AUG 10 | 88.5 | 76.0 | 59 | 78.0 | 75.0 | NR | 108.000 | 5419 | 5492.5 | 28 | 26.3 | 1628 |
| AUG 11 | 94.5 | 77.0 | 47 | 79.0 | 75.0 | NR | 111.429 | 5419 | 5495.0 | 29 | 26.2 | 1625 |
| AUG 12 | 100.0 | 77.5 | 38 | 78.0 | 74.0 | NR | 115.556 | 5419 | 5497.0 | 30 | 26.0 | 1612 |
| AUG 13 | 97.5 | 79.0 | 45 | 79.0 | 75.0 | NR | 121.622 | 5419 | 5500.0 | 31 | 26.1 | 1620 |
| AUG 14 | 98.0 | 80.0 | 46 | 80.0 | 77.5 | NR | 113.889 | 5419 | 5501.5 | 32 | 25.8 | 1598 |
| AUG 15 | 94.5 | 80.0 | 54 | 80.0 | 77.5 | NR | 117.241 | 5419 | 5504.0 | 33 | 25.8 | 1597 |
| AUG 16 | 72.0 | 71.0 | 95 | 78.0 | 71.0 | NR | 100.000 | 5419 | 5506.5 | 34 | 25.7 | 1596 |
| AUG 17 | 74.5 | 72.5 | 90 | 76.0 | 71.5 | NR | 150.000 | 5419 | 5508.5 | 35 | 25.6 | 1585 |
| AUG 18 | 86.5 | 73.0 | 55 | 76.0 | 72.0 | NR | 107.407 | 5419 | 5511.0 | 36 | 25.6 | 1584 |
| AUG 19 | 88.5 | 75.0 | 54 | 76.0 | 74.0 | NR | 107.407 | 5419 | 5512.5 | 37 | 25.3 | 1567 |
| AUG 20 | 90.0 | 76.0 | 54 | 77.0 | 75.0 | NR | 107.143 | 5419 | 5515.5 | 38 | 25.4 | 1574 |
| AUG 21 | 90.5 | 75.0 | 49 | 77.5 | 73.0 | NR | 112.903 | 5419 | 5518.5 | 39 | 25.5 | 1582 |
| AUG 22 | 90.0 | 73.0 | 45 | 78.0 | 72.0 | NR | 105.882 | 5419 | 5522.0 | 40 | 25.8 | 1597 |
| AUG 23 | 93.0 | 77.5 | 50 | 78.0 | 75.0 | NR | 116.129 | 5419 | 5524.0 | 41 | 25.6 | 1588 |
| AUG 24 | 90.5 | 77.5 | 57 | 78.0 | 75.0 | NR | 119.231 | 5419 | 5525.5 | 42 | 25.4 | 1572 |
| AUG 25 | 99.5 | 75.0 | 32 | 78.0 | 73.0 | NR | 108.163 | 5419 | 5527.5 | 43 | 25.2 | 1564 |
| AUG 26 | 98.5 | 78.5 | 42 | 79.5 | 77.0 | NR | 107.500 | 5419 | 5530.5 | 44 | 25.3 | 1571 |
| AUG 27 | 97.0 | 79.5 | 47 | 78.0 | 77.0 | NR | 114.286 | 5419 | 5532.5 | 45 | 25.2 | 1564 |
| AUG 28 | 94.5 | 80.0 | 54 | 78.5 | 76.0 | NR | 127.586 | 5419 | 5535.0 | 46 | 25.2 | 1563 |

-continued

EVAPORATIVE COOLER EXPERIMENT
SUMMER COOLING SEASON OF 1983 WITH HIGH SATURATION EFFICIENCY EXPERIMENT USING COOLER OF PATENT NO. 4,308,222
PREPARED BY F. F. KELLEY
DATE OCT. 12, 1983

| YEAR 83 DATE | HIGH TEMP. F. | WETBULB TEMP. F. | OUTSIDE HUMIDITY % | HOUSE AIR TEMPERATURE F. | COOLER OUTPUT F. | INSIDE HUMIDITY % | SATURATION EFFICIENCY % | WATTMETER STARTING NO. | DAILY READING | DAY | AVERAGE KWH/DAY | SIXTY DAY PROJECTION KWH |
|---|---|---|---|---|---|---|---|---|---|---|---|---|
| AUG 29 | 93.5 | 78.0 | 50 | 79.0 | 75.0 | NR | 119.355 | 5419 | 5538.5 | 47 | 25.4 | 1576 |
| AUG 30 | 95.0 | 79.0 | 50 | 79.5 | 77.0 | NR | 112.500 | 5419 | 5542.0 | 48 | 25.6 | 1589 |
| AUG 31 | 98.5 | 80.0 | 46 | 80.5 | 77.5 | NR | 113.514 | 5419 | 5545.0 | 49 | 25.7 | 1594 |
| SEP 1 | 98.5 | 80.5 | 47 | 81.0 | 77.5 | NR | 116.667 | 5419 | 5550.0 | 50 | 26.2 | 1624 |
| SEP 2 | 101.5 | 82.0 | 47 | 81.0 | 79.0 | NR | 115.385 | 5419 | 5552.5 | 51 | 26.2 | 1623 |
| SEP 3 | 96.5 | 80.0 | 49 | 81.0 | 76.0 | NR | 124.242 | 5419 | 5555.5 | 52 | 26.3 | 1628 |
| SEP 4 | 95.0 | 80.0 | 53 | 79.0 | 76.0 | NR | 126.667 | 5419 | 5558.5 | 53 | 26.3 | 1632 |
| SEP 5 | 96.5 | 81.0 | 52 | 80.5 | 77.5 | NR | 122.581 | 5419 | 5562.0 | 54 | 26.5 | 1642 |
| SEP 6 | 95.0 | 83.5 | 63 | 80.5 | 78.0 | NR | 147.826 | 5419 | 5566.0 | 55 | 26.7 | 1657 |
| SEP 7 | 91.0 | 80.0 | 64 | 79.0 | 75.0 | NR | 145.455 | 5419 | 5570.0 | 56 | 27.0 | 1672 |
| SEP 8 | 96.5 | 80.0 | 50 | 79.0 | 77.0 | NR | 118.182 | 5419 | 5573.0 | 57 | 27.0 | 1675 |
| SEP 9 | 98.5 | 80.0 | 47 | 79.0 | 77.0 | NR | 116.216 | 5419 | 5577.0 | 58 | 27.2 | 1689 |
| SEP 10 | 90.0 | 80.0 | 66 | 79.0 | 76.0 | NR | 140.000 | 5419 | 5581.0 | 59 | 27.5 | 1702 |
| SEP 11 | NR | NR | NR | NR | NR | NR | NR | 5419 | 5585.0 | 60 | 27.7 | 1715 |
| SEP 12 | NR | NR | NR | NR | NR | NR | NR | 5419 | 5589.0 | 61 | 27.9 | 1728 |
| SEP 13 | NR | NR | NR | NR | NR | NR | NR | 5419 | 5593.0 | 62 | 28.1 | 1740 |
| AVERAGE | 94.71 | 77.9 | 50 | 78.6 | 75.0 | | 119.142 | | | | ACTUAL | 1740 |

EVAPORATIVE COOLER 1983 (CONVENTIONAL)
SUMMER COOLING SEASON WITH CONVENTIONAL 80% SATURATION EFFICIENCY COOLER (WITH HIGH EFFICIENCY ELECTRIC MOTOR
PREPARED BY F. F. KELLEY
DATE OCT. 12, 1983

| YEAR 83 DATE | HIGH TEMP. F. | WETBULB TEMP. F. | OUTSIDE HUMDIDITY % | HOUSE AIR TEMPERATURE F. | COOLER OUTPUT F. | INSIDE HUMIDITY % | SATURATION EFFICIENCY % | WATTMETER STARTING NO. | DAILY READING | DAY | AVERAGE KWH/DAY | SIXTY DAY PROJECTION KWH |
|---|---|---|---|---|---|---|---|---|---|---|---|---|
| JUL 14 | 104.5 | 78.0 | 32 | 86.9 | 83.3 | NR | 80.000 | 5419 | 5422.0 | 1 | 30.0 | 1860 |
| JUL 15 | 101.0 | 77.0 | 40 | 85.4 | 81.8 | NR | 80.000 | 5419 | 5425.0 | 2 | 30.0 | 1860 |
| JUL 16 | 99.5 | 76.5 | 37 | 84.7 | 81.1 | NR | 80.000 | 5419 | 5428.5 | 3 | 31.7 | 1963 |
| JUL 17 | 101.0 | 77.0 | 35 | 85.4 | 81.8 | NR | 80.000 | 5419 | 5431.0 | 4 | 30.0 | 1860 |
| JUL 18 | 94.0 | 75.0 | 40 | 82.4 | 78.8 | NR | 80.000 | 5419 | 5433.0 | 5 | 28.0 | 1736 |
| JUL 19 | 100.0 | 75.0 | 32 | 83.6 | 80.0 | NR | 80.000 | 5419 | 5435.0 | 6 | 26.7 | 1653 |
| JUL 20 | 92.0 | 74.5 | 45 | 81.6 | 78.0 | NR | 80.000 | 5419 | 5437.0 | 7 | 25.7 | 1594 |
| JUL 21 | 84.0 | 76.5 | 73 | 81.6 | 78.0 | NR | 80.000 | 5419 | 5440.0 | 8 | 26.3 | 1628 |
| JUL 22 | 89.5 | 78.5 | 63 | 84.3 | 80.7 | NR | 80.000 | 5419 | 5441.0 | 9 | 24.4 | 1516 |
| JUL 23 | 99.5 | 82.0 | 49 | 89.1 | 85.5 | NR | 80.000 | 5419 | 5444.0 | 10 | 25.0 | 1550 |
| JUL 24 | 99.0 | 82.5 | 64 | 89.4 | 85.8 | NR | 80.000 | 5419 | 5446.5 | 11 | 25.0 | 1550 |
| JUL 25 | 95.5 | 77.5 | 47 | 84.7 | 81.1 | NR | 80.000 | 5419 | 5450.0 | 12 | 25.8 | 1602 |
| JUL 26 | 100.0 | 75.0 | 32 | 83.6 | 80.0 | NR | 80.000 | 5419 | 5451.0 | 13 | 24.6 | 1526 |
| JUL 27 | 97.0 | 79.0 | 47 | 86.2 | 82.6 | NR | 80.000 | 5419 | 5453.5 | 14 | 24.6 | 1528 |
| JUL 28 | 98.0 | 75.0 | 34 | 83.2 | 79.6 | NR | 80.000 | 5419 | 5456.0 | 15 | 24.7 | 1529 |
| JUL 29 | 100.5 | 78.5 | 40 | 86.5 | 82.9 | NR | 80.000 | 5419 | 5458.5 | 16 | 24.7 | 1531 |
| JUL 30 | 97.0 | 77.0 | 37 | 84.6 | 81.0 | NR | 80.000 | 5419 | 5462.0 | 17 | 25.3 | 1568 |
| JUL 31 | 97.5 | 82.0 | 53 | 88.7 | 85.1 | NR | 80.000 | 5419 | 5465.0 | 18 | 25.6 | 1584 |
| AUG 1 | 100.0 | 80.0 | 44 | 87.6 | 84.0 | NR | 80.000 | 5419 | 5467.5 | 19 | 25.5 | 1583 |
| AUG 2 | 100.5 | 78.0 | 48 | 86.1 | 82.5 | NR | 80.000 | 5419 | 5471.0 | 20 | 26.0 | 1612 |
| AUG 3 | 98.0 | 80.0 | 47 | 87.2 | 83.6 | NR | 80.000 | 5419 | 5473.0 | 21 | 25.7 | 1594 |
| AUG 4 | 92.0 | 76.0 | 37 | 82.8 | 79.2 | NR | 80.000 | 5419 | 5475.5 | 22 | 25.7 | 1592 |
| AUG 5 | 92.5 | 80.0 | 60 | 86.1 | 82.5 | NR | 80.000 | 5419 | 5478.0 | 23 | 25.7 | 1590 |
| AUG 6 | 102.5 | 79.0 | 38 | 87.3 | 83.7 | NR | 80.000 | 5419 | 5481.5 | 24 | 26.0 | 1615 |
| AUG 7 | 93.0 | 79.0 | 55 | 85.4 | 81.8 | NR | 80.000 | 5419 | 5484.0 | 25 | 26.0 | 1612 |
| AUG 8 | 85.0 | 77.0 | 70 | 82.2 | 78.6 | NR | 80.000 | 5419 | 5487.0 | 26 | 26.2 | 1622 |
| AUG 9 | 91.0 | 76.0 | 50 | 82.6 | 79.0 | NR | 80.000 | 5419 | 5491.0 | 27 | 26.7 | 1653 |
| AUG 10 | 88.5 | 76.0 | 59 | 82.1 | 78.5 | NR | 80.000 | 5419 | 5492.5 | 28 | 26.3 | 1628 |
| AUG 11 | 94.5 | 77.0 | 47 | 84.1 | 80.5 | NR | 80.000 | 5419 | 5495.0 | 29 | 26.2 | 1625 |
| AUG 12 | 100.0 | 77.5 | 38 | 85.6 | 82.0 | NR | 80.000 | 5419 | 5497.0 | 30 | 26.0 | 1612 |
| AUG 13 | 97.5 | 79.0 | 45 | 86.3 | 82.7 | NR | 80.000 | 5419 | 5500.0 | 31 | 26.1 | 1620 |
| AUG 14 | 98.0 | 80.0 | 46 | 87.2 | 83.6 | NR | 80.000 | 5419 | 5504.5 | 32 | 25.8 | 1598 |
| AUG 15 | 94.5 | 80.0 | 54 | 86.5 | 82.9 | NR | 80.000 | 5419 | 5504.0 | 33 | 25.8 | 1597 |
| AUG 16 | 72.0 | 71.0 | 95 | 74.8 | 71.2 | NR | 80.000 | 5419 | 5506.5 | 34 | 25.7 | 1596 |
| AUG 17 | 74.5 | 72.5 | 90 | 76.5 | 72.9 | NR | 80.000 | 5419 | 5508.5 | 35 | 25.6 | 1585 |
| AUG 18 | 86.5 | 73.0 | 55 | 79.3 | 75.7 | NR | 80.000 | 5419 | 5511.0 | 36 | 25.6 | 1584 |
| AUG 19 | 88.5 | 75.0 | 54 | 81.3 | 77.7 | NR | 80.000 | 5419 | 5512.5 | 37 | 25.3 | 1567 |
| AUG 20 | 90.0 | 76.0 | 54 | 82.4 | 78.8 | NR | 80.000 | 5419 | 5515.5 | 38 | 25.4 | 1574 |
| AUG 21 | 90.5 | 75.0 | 49 | 81.7 | 78.1 | NR | 80.000 | 5419 | 5518.5 | 39 | 25.5 | 1582 |
| AUG 22 | 90.0 | 73.0 | 45 | 80.0 | 76.1 | NR | 80.000 | 5419 | 5522.0 | 40 | 25.8 | 1597 |
| AUG 23 | 93.0 | 77.5 | 50 | 84.2 | 80.6 | NR | 80.000 | 5419 | 5524.0 | 41 | 25.6 | 1588 |
| AUG 24 | 90.5 | 77.5 | 57 | 83.7 | 80.1 | NR | 80.000 | 5419 | 5525.5 | 42 | 25.4 | 1572 |
| AUG 25 | 99.5 | 75.0 | 32 | 83.5 | 79.9 | NR | 80.000 | 5419 | 5527.5 | 43 | 25.2 | 1564 |
| AUG 26 | 98.5 | 78.5 | 42 | 86.1 | 82.5 | NR | 80.000 | 5419 | 5530.5 | 44 | 25.3 | 1571 |
| AUG 27 | 97.0 | 79.5 | 47 | 86.6 | 83.0 | NR | 80.000 | 5419 | 5532.5 | 45 | 25.2 | 1564 |
| AUG 28 | 94.5 | 80.0 | 54 | 86.5 | 82.9 | NR | 80.000 | 5419 | 5535.0 | 46 | 25.2 | 1563 |

-continued

EVAPORATIVE COOLER 1983 (CONVENTIONAL)
SUMMER COOLING SEASON WITH CONVENTIONAL 80% SATURATION EFFICIENCY COOLER (WITH HIGH EFFICIENCY ELECTRIC MOTOR
PREPARED BY F. F. KELLEY
DATE OCT. 12, 1983

| YEAR 83 DATE | HIGH TEMP. F. | WETBULB TEMP. F. | OUTSIDE HUMDIDITY % | HOUSE AIR TEMPERATURE F. | COOLER OUTPUT F. | INSIDE HUMIDITY % | SATURATION EFFICIENCY % | WATTMETER STARTING NO. | DAILY READING | DAY | AVERAGE KWH/DAY | SIXTY DAY PROJECTION KWH |
|---|---|---|---|---|---|---|---|---|---|---|---|---|
| AUG 29 | 93.5 | 78.0 | 50 | 84.7 | 81.1 | NR | 80.000 | 5419 | 5538.5 | 47 | 25.4 | 1576 |
| AUG 30 | 95.0 | 79.0 | 50 | 85.8 | 82.2 | NR | 80.000 | 5419 | 5542.0 | 48 | 25.6 | 1589 |
| AUG 31 | 98.5 | 80.0 | 46 | 87.3 | 83.7 | NR | 80.000 | 5419 | 5545.0 | 49 | 25.7 | 1594 |
| SEP 1 | 98.5 | 80.5 | 47 | 87.7 | 84.1 | NR | 80.000 | 5419 | 5550.0 | 50 | 26.2 | 1624 |
| SEP 2 | 101.5 | 82.0 | 47 | 89.5 | 85.9 | NR | 80.000 | 5419 | 5525.5 | 51 | 26.2 | 1623 |
| SEP 3 | 96.5 | 80.0 | 49 | 86.9 | 83.3 | NR | 80.000 | 5419 | 5555.5 | 52 | 26.3 | 1628 |
| SEP 4 | 95.0 | 80.0 | 53 | 86.6 | 83.0 | NR | 80.000 | 5419 | 5558.5 | 53 | 26.3 | 1632 |
| SEP 5 | 96.5 | 81.0 | 52 | 87.7 | 84.1 | NR | 80.000 | 5419 | 5562.0 | 54 | 26.5 | 1642 |
| SEP 6 | 95.0 | 83.5 | 63 | 89.4 | 85.8 | NR | 80.000 | 5419 | 5566.0 | 55 | 26.7 | 1657 |
| SEP 7 | 91.0 | 80.0 | 64 | 85.8 | 82.2 | NR | 80.000 | 5419 | 5570.0 | 56 | 27.0 | 1672 |
| SEP 8 | 96.5 | 80.0 | 50 | 86.9 | 83.3 | NR | 80.000 | 5419 | 5573.0 | 57 | 27.0 | 1675 |
| SEP 9 | 98.5 | 80.0 | 47 | 87.3 | 83.7 | NR | 80.000 | 5419 | 5577.0 | 58 | 27.2 | 1689 |
| SEP 10 | 90.0 | 80.0 | 66 | 87.6 | 82.0 | NR | 80.000 | 5419 | 5581.0 | 59 | 27.5 | 1702 |
| SEP 11 | NR | NR | NR | NR | NR | NR | NR | 5419 | 5585 | 60 | 27.7 | 1715 |
| SEP 12 | NR | NR | NR | NR | NR | NR | NR | 5419 | 5589 | 61 | 27.9 | 1728 |
| SEP 13 | NR | NR | NR | NR | NR | NR | NR | 5419 | 5593 | 62 | 28.1 | 1740 |
| AVERAGE | 94.71 | 77.9 | 50 | 84.9 | 81.3 | | 80.000 | | | | ACTUAL | 1740 |

As can be seen from the foregoing data, the result was the air temperature in the cooled air space in the house was 6.3 degrees lower using this invention than the temperature achieved by a conventional 80% saturation efficiency cooler.

Figure 7:
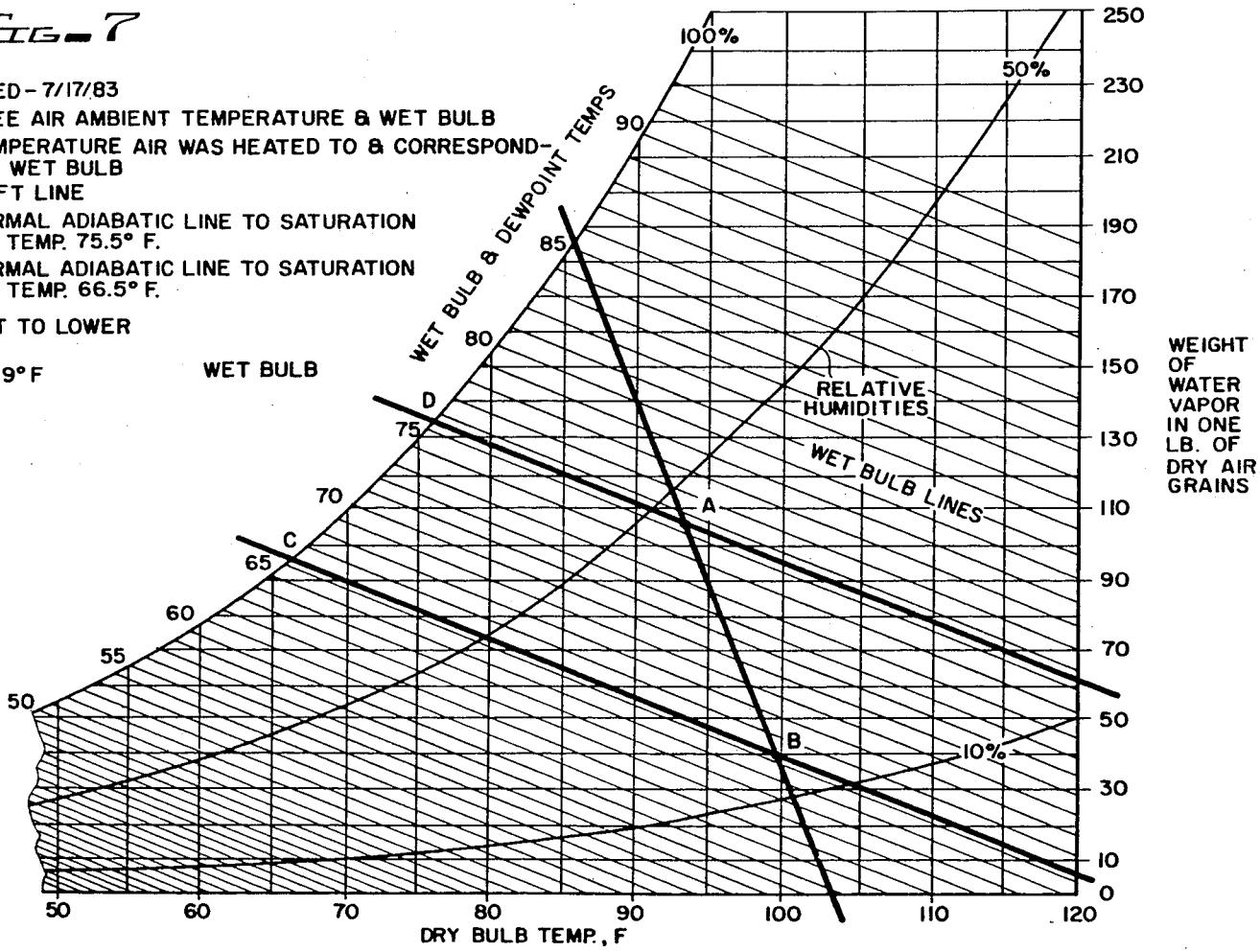
FIG. 7 is a psychrometric chart showing the shift which occurs to lower the saturation temperature by raising temperature of the free air with the present invention.

The chart of FIG. 7 is a psychrometric chart showing ambient air temperature, cooler air intake temperature as a result of enthalpic heating and the resulting improvement from data taken July 17, 1983. Point A is the free air ambient temperature and wet bulb temperature. Point B is the temperature to which the air was heated using the invention and the corresponding wet bulb. The improvement or shift lowering the web bulb is 90° F. resulting in substantial increase in efficiency and lowered air temperature.

The enthalpic heating system was tested during the winter of 1981–1982 with the system again used in conjunction with a cooler according to U.S. Pat. No. 4,308,222 and modified as shown in FIGS. 5 and 6. For the next months of the heating season, electrical power usage in KWH and dollars were compared to the previous same six months in 1980–1981 in which a conventional heat pump was used to heat. Electrical power consumption for heating the house was reduced 48% and the temperature was maintained at a comfortable 72 degrees even though the winter for the test period was about 15% colder in degree days than the year 1981 which served as the comparison year. Had the winters been comparable, approximately 60% savings would have been realized.

As has been described above, heating ambient air prior to evaporative treatment causes a shift in the wet bulb temperature as compared to the ambient temperature. Therefore, when cooling occurs, it occurs along an adiabatic line so that a 100% saturation efficiency, a lower dry bulb temperature is achieved. With the system described relative to FIGS. 5 and 6, ambient air is heated by solar energy at the beginning of the cycle resulting in increase in enthalpy in the immediate atmospheric air mass. Once the air is heated to higher temperature, the enthalpy remains constant throughout the process. The evaporative cooling process is adiabatic after heat has been added to the atmospheric air prior to entry into the evaporative cooler. In FIG. 7, line A–D is the adiabatic line to saturation and line B–C is the adiabatic line to saturation after the air is heated following the teachings of the invention.

For purposes of the present application, the phenomena has been designated heat induced mass transfer of water vapor in the earth's free atmosphere. It has been discovered that as an air mixture progressively heats up, the dry and wet bulb temperatures progressively increase and the air mixture becomes less dense. It also appears that a shift in the wet bulb temperature of the air will occur along a line of constant density on the standard psychrometric chart when enthalpic heat is added. If enthalpic heat is added to air at a point along the constant density line representing a predetermined wet bulb temperature, the heating effect warms the air forcing the wet bulb temperature downward along the constant density line resulting in lower wet bulb temperature. An evaporative cooler theoretically capable of 100% air saturation can take advantage of this effect and produce colder air than is possible if the air mass prior to entry to the evaporative cooler had not been heated.

As is well known, air is a mixture of nitrogen, oxygen and water vapor and other trace gases. In order to lower the wet bulb, water in the form of water vapor must be transferred out of the heated air mixture. To maintain the constant density of the air mass, nitrogen and oxygen must be transferred to the heated air system from the general atmospheric air mass. Therefore, two-way mass transfer mechanism appears to occur between the heated air mass and the general air mass in the geographic area.

This can be demonstrated by a general equation that has constant density value and equilibrium has been shifted with the application of heat:

$$\underset{\text{HEAT}}{\overset{\text{CONSTANT DENSITY}}{(N_2 + O_2) + H_2O}} \underset{\rightarrow(H_2O)\rightarrow}{\overset{\leftarrow(N_2 + O_2)\leftarrow}{\rightleftarrows}} \overset{\text{CONSTANT DENSITY}}{(N_2 + O_2) + H_2O}$$

In the preceding example, heat has been added to the left side of the equation. Water is transferred to the left side of the equation to the general air mass. Nitrogen and oxygen are shifted from the general air mass to the left and constant density is maintained on both sides of the equation. The net result is a localized warmer air mass having a lower wet bulb in the vicinity of the evaporative cooler. The general free air mass is insignificantly cooler and its wet bulb temperature has insignificantly increased.

The foregoing phenomena can be induced by solar heating means as has been previously described. In addition, it is feasible and economical in some applications to utilize heat from sources other than solar energy to promote lowering of the wet bulb temperature to produce cooler air from an evaporative cooler unit at night or on cloudy days. Evaporative cooling using air heated by sources other than solar, for example, electricity as a source of heat, result in approximately 50% cost savings as compared to cooling BTU's produced by gas cycle refrigeration or a heat pump.

Figures 8, 9:
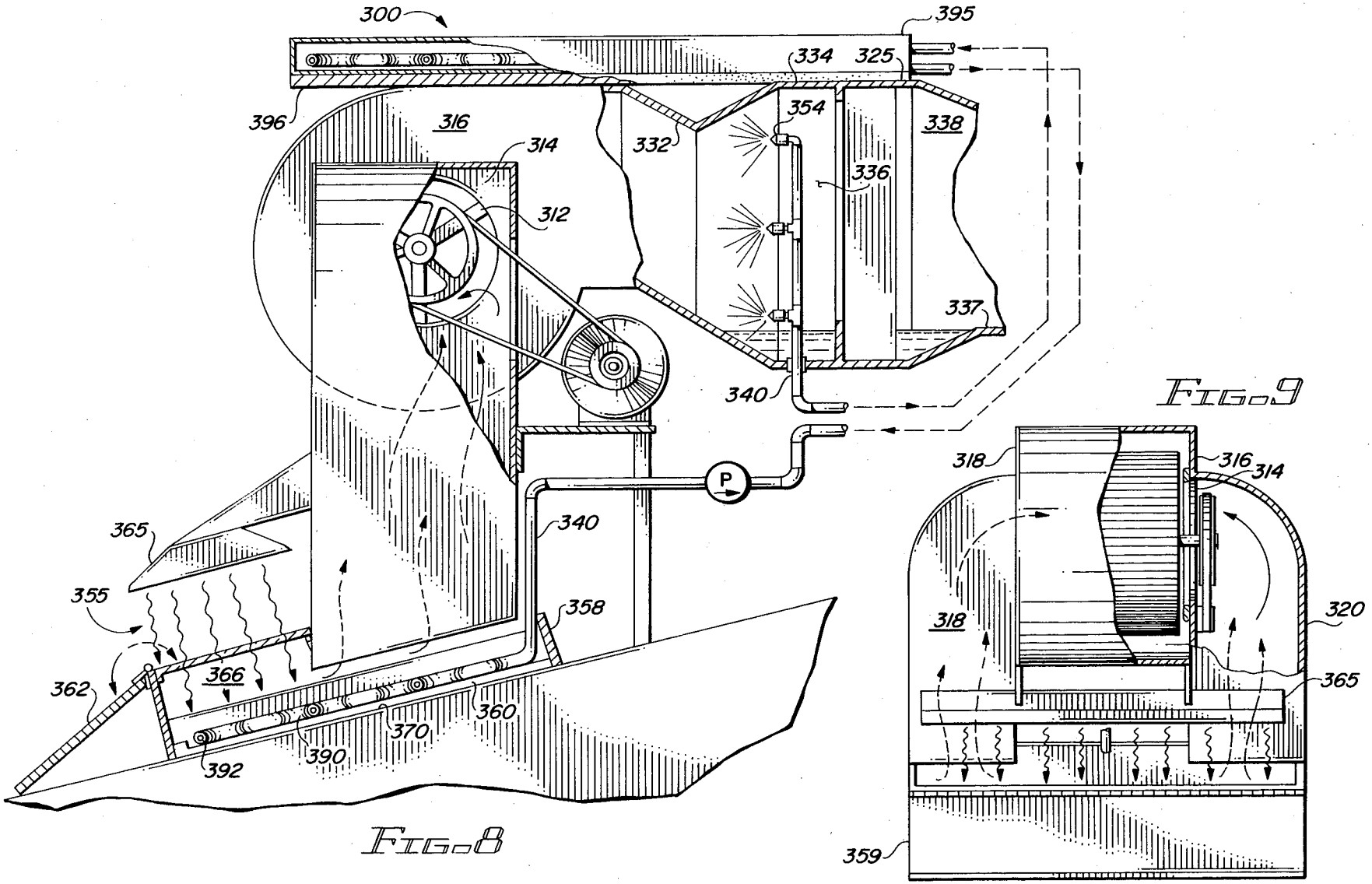
FIG. 8 is a side view of a cooler incorporating enthalpic heating of air by non-solar means.
FIG. 9 is an end view of the cooler of FIG. 8.

Accordingly, FIGS. 8 and 9 show the enthalpic system of the present invention in connection with an evaporative cooler using auxilliary heating from a non-solar source. FIG. 8 shows an improved cooler of the general type has been described with reference to FIG. 5. Briefly, the improved cooler 300 includes a centrifugal blower 312 or other air-moving device having axial inlets 314 formed in the opposite sidewalls 316 and 318 of the housing. The blower is driven by an electric motor through a belted pulley arrangement and the motor is preferably a highefficiency capacitor start-/capacitor run motor of the type previously described. An elongated evaporator duct 325 is positioned to receive air under pressure from blower 312. The air inlet duct section 332 converges and is integral with the main enlarged duct section 334 which defines an expansion chamber 336. The opposite end of the main duct section is reduced to form an outlet air section 337 which defines an air outlet port 338. Subsequent tandemly arranged sections of similar construction may be provided downstream of the blower. Water is supplied to the cooler by line 340 which, as will be explained hereafter, may include one or more heat exchange sections.

The water line is connected to a plurality of spray nozzles 354 so that water supplied under pressure is sprayed into a finely divided mist from the nozzles in a direction which extend angularly upward from the nozzle countercurrent to the air movement through the air inlet duct section 332. Accordingly, evaporation and cooling of the incoming air occurs within the air inlet duct 332 and because of the angular attitude of the air inlet duct section, migration of the moisture to the moving air is inhibited. It is to be noted the enthalpic cooling feature will benefit all types of evaporative coolers and the cooler described above is of the type shown in my prior patent, U.S. Pat. No. 4,308,222.

A heating box 355 is positioned at the inlet to ducts 318 and 320 with the lower end of these ducts depending into box 355. The box has opposite side walls 358, end walls 359, and a floor 360. Floor 360 is preferably a heat absorbant material such as a metal coated with a black coating 370. A cover 362 is hinged to one side wall 358. Cover 362 is glazed and is configured to accomodate the lower end of ducts 318 and 320 and in a closed position defines a heating chamber 366. The cover is normally only closed during cool periods in which periods the heating box acts as a solar heater with the evaporative cooler operation discontinued utilizing only the blower 312 as an air mover for moving heated air from chamber 366 to the interior space.

In the normal cooling mode of operation, cover 362 is open with a heat absorbant coating 370 on bottom 360 exposed to an auxiliary heat source 365. As shown, the auxilliary heat source 365 may be an infrared heat lamp connected to a source of electrical energy. Other types of heating may be employed such as quartz heater. Resistance heater elements may be placed or embedded at the heat absorber surface 370 or heat sources using combustible fuels may also be used. Heat source 365 serves to heat air in the vicinity to the intake or ducts 318 and 320 with air heated principally by convention due to the heat absorbant surface 370. The side and end walls 358, 359 serve as a wind barrier to prevent dissipation of the heated air.

To further enhance evaporation, as best seen in FIG. 8, section 390 of the incoming water line 340 is formed as a series of coils 392 disposed immediately above floor 360 of the solar heat box. Thus, the proximity of these coils to the absorbant surface 370 and the exposure of the upper side of the coils directly to the heat source will cause the water within the coil section 392 to be elevated in temperature prior to introduction of the water into the spray nozzles or evaporator pads. Additional solar heating of the incoming water may also be induced at heat exchanger section 395 located at the exposed upper surface of the cooler. A layer or insulation 396 is interposed between the section 395 and the cooler. It has been found that by preheating the water prior to evaporation results in faster evaporation rates.

Figure 11:
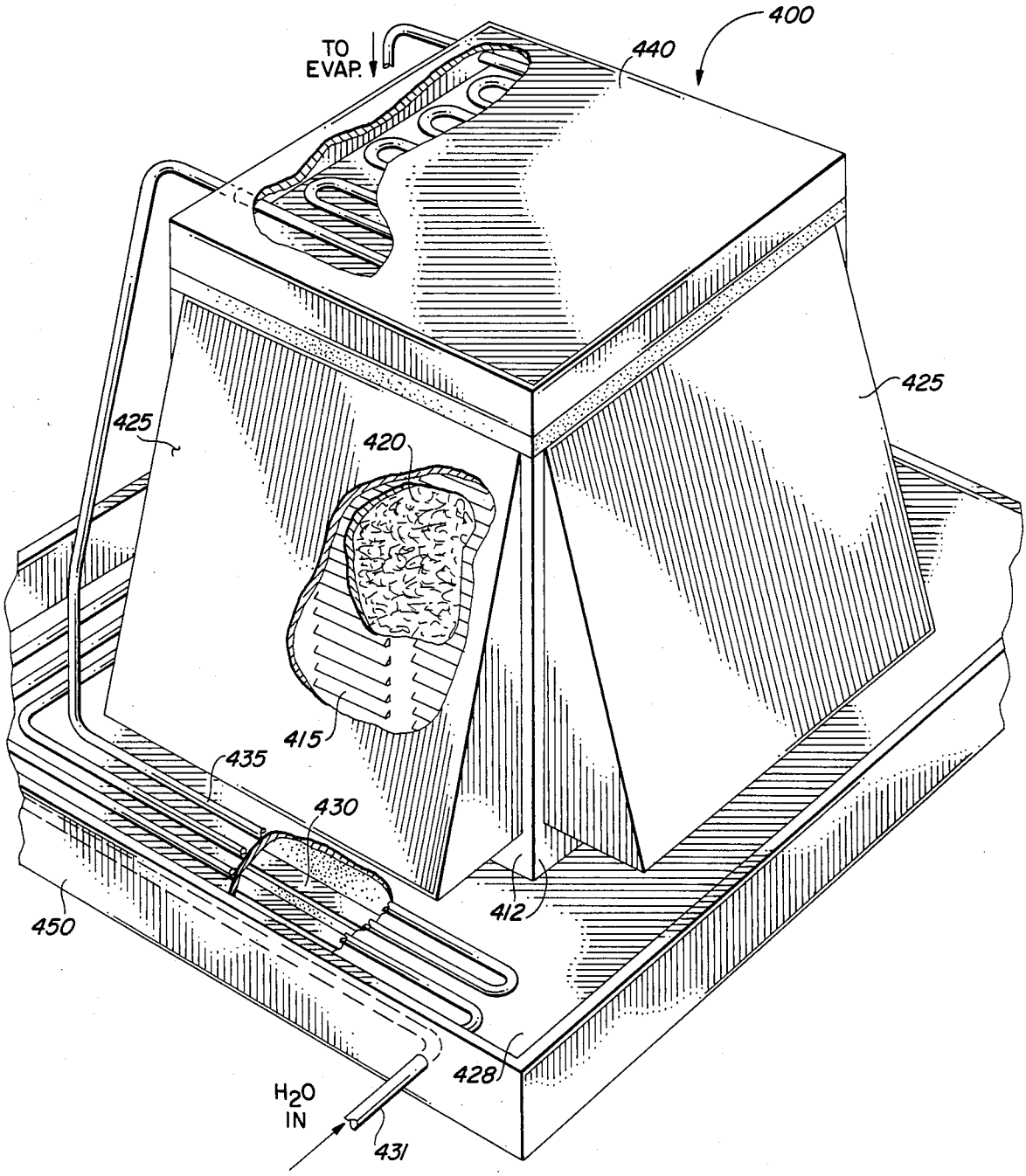
FIG. 11 is a perspective view of a conventional cooler incorporating electrical heating means to achieve improved saturation efficiency.

The improved enthalpic system of the present invention will work well with a conventional cooler utilizing excelsior or other pads such as pads of synthetic honeycomb material, as for example that sold under the trademark Celdek. FIG. 11 shows a conventional cooler generally designated by the numeral 400 having rectangular sides 412 defining openings on louvers 415 for admission of air through the adjacent evaporative treatment pad 420. The evaporative treatment pad 420 may be a conventional excelsior pad or a synthetic honeycomb-type pad oriented in a position with the long slotted pad running vertically. This orientation is preferred so that water will not collect and be trapped in large drops within the pad media. Large drops tend to reduce the wet bulb temperature and retard evaporation rates and also restrict air flow through the pad. It is also preferred that a wetting agent, as for example a non-foaming detergent, be added to the water applied to the pads. The wetting agent will reduce surface tension to result in a breakdown of the water drops which will otherwise tend to collect in the pad.

Cooler 400 is provided with ducts or shields 425 enclosing the air intake louvers at the four sides of the cooler. The ducts extent to an elevation just above surface 428 which may be exposed to solar radiation. Surface 428 in the area adjacent the cooler and immediately adjacent the lower intake end of the ducts 425 is preferably a dark, heat-absorbant material and further includes artificial heating shown as electrical heating resistant elements 430 embedded in the material. Water line 431 has a heat exchange section 435 disposed immediately above the heating pad 430. A second heat exchange section 440 is connected in the water line and positioned at the upper surface of the cooler to be fully exposed to solar radiation. Preheating the water improves evaporation rates and the heated water is distributed across the top of the pads 420 in known fashion. It is preferred that a wind barrier 450 extend peripherally about the cooler and the periphery of the heating pad.

The heating elements 430 may be activated to heat air in the vicinity of the lower ends of the intake ducts 425 when solar radiation is insufficient, such as during cooler periods or night time. In other respects, the evaporative cooler of FIG. 11 operates as has been described previously with reference to FIGS. 8 and 9. It is noted, the configuration shown in FIG. 11 is well adapted to retrofitting of existing coolers.

An experiment was conducted to determine the effectiveness of the heating effect and mass transfer phenomena using an alternate heat source. A 10,000 BTU quartz infrared electric heater was placed in heating relationship with the intake of an evaporative cooler arranged generally as shown in FIGS. 8 and 9 on the roof of a residence. The heater consumed 3000 watts per hour at a cost of $0.08/KWH or 24 cents per hour and was used to heat intake air to the cooler during nighttime periods. At night, when no solar heat was available on the roof, the saturation efficiency increased from 100% to 148% clearly indicating an increase in cooler performance. An analysis of the cost of these additional cooling BTU's indicated they were being produced at about one-half the cost of conventional cooling BTU's provided by compressed gas cycle air conditioning.

Figure 10:
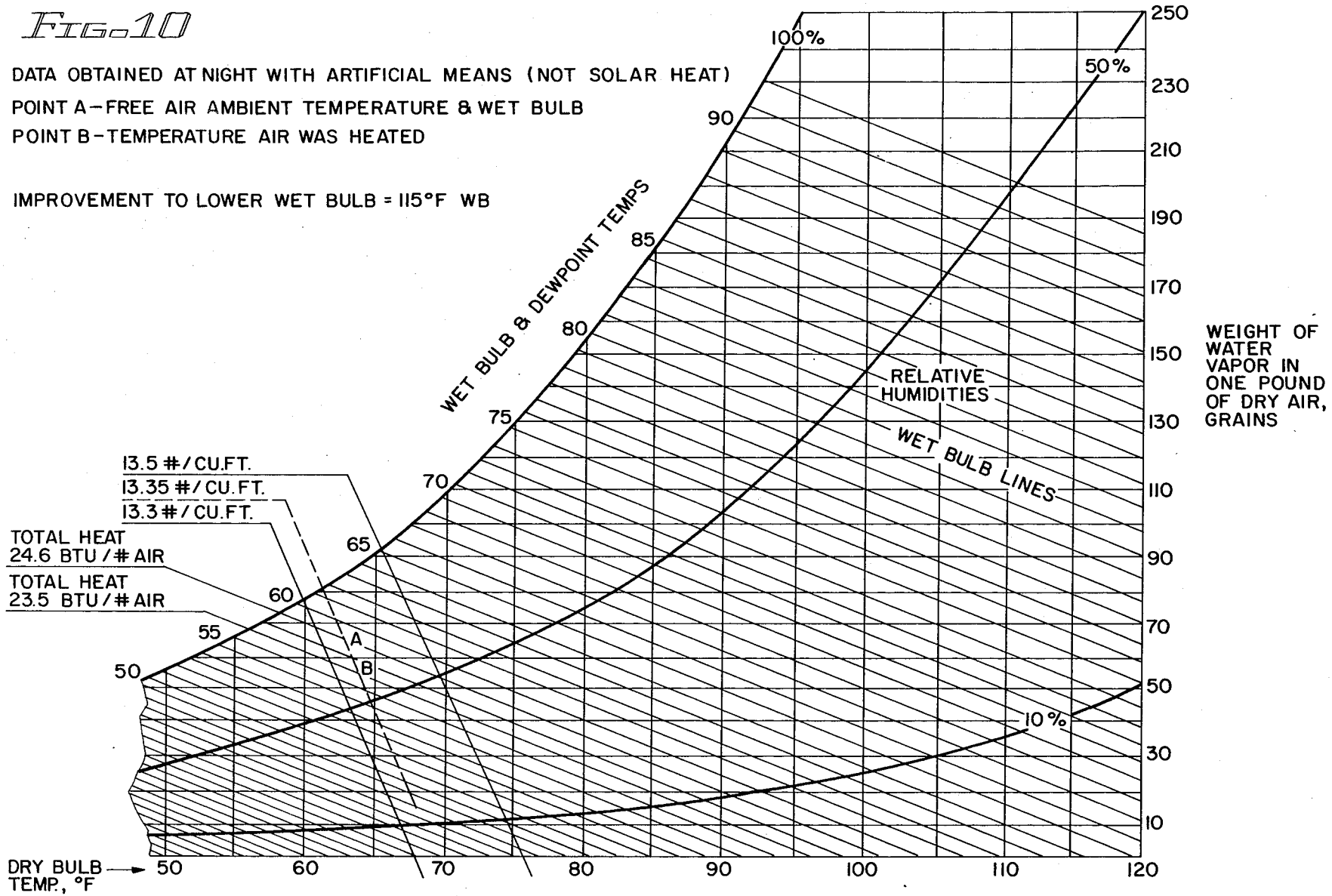
FIG. 10 is a psychrometric chart demonstrating the improved cooling effectiveness achieved with a cooler constructed as shown in FIGS. 8 and 9.

The conculsion was that it is feasible to add purchased heat to the free solar day heat and also at night to economically increase the effectiveness of evaporative cooling by artificial heating of the intake air. The results of the night time test are illustrated in FIG. 10 which demonstrates the shift in wet bulb achieved by addition of heat from a non-solar source and the resulting increase in saturation efficiency.

It will be obvious to those skilled in the art to make various changes, modifications and alterations to the invention described herein. To the extent that these changes and modifications do not depart from the spirit and scope of the appended claims, they are intended to be encompassed therein.

I claim:

1. An improved enthalpic cooling apparatus for use with an evaporative cooling device which includes a housing having an intake open to ambient air and a discharge, air delivery means having a motor for inducing an airflow path from the said intake to discharge, and evaporative treatment means including a water supply in said airflow path for effecting evaporative cooling, said improved apparatus comprising air heating means for heating the air introduced at said intake above ambient temperature thereby decreasing the wet bulb temperature.

2. The improved apparatus of claim 1 further including duct means associated with said intake, said duct means having an inlet communicating with ambient air.

3. The apparatus of claim 1 further including heat exchanger means interposed to heat said water supply prior to evaporative air treatments, said heat exchanger positioned to receive solar energy.

4. The apparatus of claim 3 wherein said heat exchanger is disposed above said cooling apparatus to at least partially shade said cooling apparatus.

5. The apparatus of claim 1 wherein said enthalpic heating means comprises heat absorbing material adjacent said intake and heat generating means disposed to heat the absorbing material and the air in the area adjacent said intake.

6. The apparatus of claim 2 further including wind barrier means extending in the area of said inlet to prevent wind dilution of the heated air.

7. The apparatus of claim 4 wherein said evaporative treatment means comprises at least one wettable evaporative pad in the airflow path.

8. The apparatus of claim 7 wherein said pad is a synthetic honeycomb pad having a vertically oriented water path within the honeycomb.

9. The apparatus of claim 4 wherein said evaporative treatment means comprises at least one spray nozzle disposed to spray water into said air flow path.

10. The apparatus of claim 7 wherein said pad is wetted with water and a wetting agent.

11. The apparatus of claim 4 further including heat exchanger means associated with said heat generating means to heat the said water supply prior to delivery to said evaporative treatment means.

12. The apparatus of claim 5 wherein said wind barrier comprises a housing having an upstanding side wall and a removable transparent cover.

13. The apparatus of claim 4 wherein said heat generating means comprises electrical heating means.

14. The apparatus of claim 2 wherein said motor is a high efficiency capacitor start/capacitor run electric motor.

15. A method of cooling evironmental ambient air having an ambient temperature for introduction into a space to be cooled comprising:

(a) establishing a zone within the ambient environment which zone is in communication with environmental ambient air;

(b) heating the air in said zone to increase the enthalpy and lower the wet bulb temperature;

(c) establishing an evaporative treatment stage to effect evaporization and cooling of air introduced therein;

(d) transferring air from said zone to said evaporative stage to be cooled and discharged into the space to be cooled.

* * * * *